US006341207B1

(12) United States Patent
Sasaki et al.

(10) Patent No.: US 6,341,207 B1
(45) Date of Patent: Jan. 22, 2002

(54) CLEANERLESS IMAGE FORMING METHOD AND SYSTEM THEREFOR

(75) Inventors: Sachio Sasaki; Jun Kodama; Tomohisa Mikami; Masatoshi Kimura, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/503,162

(22) Filed: Feb. 14, 2000

Related U.S. Application Data

(63) Continuation of application No. 08/070,889, filed on Jun. 3, 1993, now abandoned.

(30) Foreign Application Priority Data

Jun. 16, 1992 (JP) ..... 4-156805

(51) Int. Cl.[7] ..... G03G 15/24
(52) U.S. Cl. ..... 399/149; 399/150
(58) Field of Search ..... 399/149, 150

(56) References Cited

U.S. PATENT DOCUMENTS

| | | | |
|---|---|---|---|
| 4,588,279 | A | 5/1986 | Fukuchi et al. |
| 4,769,676 | A | 9/1988 | Mukai et al. |
| 4,843,423 | A | 6/1989 | Nakamura et al. |
| 4,969,015 | A | 11/1990 | Sanpe |
| 4,977,430 | A | 12/1990 | Florack et al. |
| 5,101,238 | A | 3/1992 | Creveling et al. |
| 5,148,219 | A | 9/1992 | Kohyama |
| 5,196,892 | A | 3/1993 | Mitsuaki |
| 5,260,746 | A | 11/1993 | Yoshida et al. |
| 5,303,014 | A | 4/1994 | Yu et al. |
| 5,331,383 | A | 7/1994 | Nou et al. |

FOREIGN PATENT DOCUMENTS

| | | |
|---|---|---|
| DE | 3338989 | 5/1984 |
| EP | 354 310 A1 | 2/1990 |
| EP | 0 390 599 A2 | 3/1990 |
| EP | 0400 563 | 12/1990 |
| EP | 0459607 | 12/1991 |
| JP | 58-199365 | 11/1983 |

(List continued on next page.)

OTHER PUBLICATIONS

EPO Search Report EP 90 11 0132 for Reference "AG" EP 0 400 563.

"Development of Spherical Toners by Polymerization Method and Its View in Future," Material Report R&D, pp. 25–30, Oct., 1990.

"Clearness Laser Printer Using Monocomponent Nonmagnetic Development System," M. Hosoya et al. dated Jul. 16, 1991.

*Primary Examiner*—William J. Royer
(74) *Attorney, Agent, or Firm*—Staas & Halsey LLP

(57) ABSTRACT

A cleanerless image forming apparatus and a cleanerless image forming method facilitate the collection of residual toners after image transfer. The image forming apparatus includes a rotary endless latent carrier, a rotary charging brush for charging the rotary endless latent carrier, and a unit for forming an electrostatic latent image on the rotary endless latent carrier. The electrostatic latent image is developed on the rotary endless latent carrier by supplying polymerization toners simultaneously with the cleaning of residual polymerization toners therefrom. The polymerization toners on the rotary endless latent carrier are then transferred to a sheet. The image forming method has a first operation of charging a rotary endless latent carrier; a second operation of forming an electrostatic latent image on the rotary endless latent carrier; a third operation of developing the electrostatic latent image on the rotary endless latent carrier by supplying polymerization toners simultaneously with cleaning residual polymerization toners therefrom; and a fourth operation of transferring the polymerization toners on the rotary endless latent carrier to a sheet.

11 Claims, 17 Drawing Sheets

FOREIGN PATENT DOCUMENTS

| | | |
|---|---|---|
| JP | 62-203183 | 9/1987 |
| JP | 63-113482 | 5/1988 |
| JP | 63-201670 | 8/1988 |
| JP | 64-6988 IP (1-6988) | 1/1989 |
| JP | 2-51168 | 2/1990 |
| JP | 2-64668 | 3/1990 |
| JP | 2-228683 | 9/1990 |
| JP | 2-264987 | 10/1990 |
| JP | 2-302 772 | 12/1990 |
| JP | 2-304586 | 12/1990 |
| JP | 4-34566 | 2/1992 |
| JP | 4-102884 | 4/1992 |
| JP | 4-366863 | 12/1992 |
| JP | 5-53414 | 3/1993 |

CLEANERLESS IMAGE FORMING METHOD AND SYSTEM THEREFOR

This application is a Continuation of application Ser. No. 08/070,889, filed Jun. 3, 1993, now abandoned.

BACKGROUND OF THE INVENTION

1. Field of the Invention

The present invention relates to an image forming method and image forming apparatus, and, more particularly, to an image forming method which collects residual toners on a latent carrier with a developing device to thereby eliminate a cleaner, and an apparatus for accomplishing the same.

2. Description of the Related Art

In image recording apparatuses, such as a copying machine, a printer and a facsimile, a latent image forming apparatus like an electrophotographic apparatus is used due to the popularity of image recording on normal sheets of paper. Such an image forming apparatus will be described below as a typical electrophotographic printer. As shown in FIG. 1A, various types of process units are disposed around a photosensitive drum 1, such as an organic photosensitive body, Se photosensitive body or a-Si photosensitive body. More specifically, arranged around the photosensitive drum 1 are a corona charger 2 for uniformly charging the surface of the photosensitive drum 1, a laser optical system 3 for performing image exposure, a developing device 4, such as a two-component developing device, magnetic one-component developing device or non-magnetic one-component developing device, a corona discharger 5 for electrostatically transferring a toner image on the photosensitive drum 1 onto a paper P, a cleaner 6 such as a fur brush cleaner or a blade cleaner, and a deelectrifying lamp 7. A fixing device 8 for fixing the toner image on the paper P with heat and pressure is further provided on a sheet-conveying passage where the paper P is conveyed.

The image forming operation is performed in the following manner. First, the surface of the photosensitive drum 1 is uniformly charged by the corona charger 2 and then the charged surface is exposed with an optical image corresponding to a target image by the laser optical system 3, thus forming an electrostatic latent image corresponding to the target image. Then, charged toners are supplied from this developing device 4 to the electrostatic latent image on the photosensitive drum 1 to develop the image. The corona discharger 5 as a transfer device is disposed in the vicinity of the photosensitive drum 1 with the paper P in between, and charges the back of the conveyed paper P to the opposite polarity to that of the charges of the toners, thereby electrostatically transferring the toner image on the photosensitive drum 1 onto the paper P. While the paper P carrying this toner image passes through the fixing device 8, the toner image is fixed on the paper P with heat and pressure, completing the printing.

The efficiency of transferring the toner image on a sheet of paper is not 100%, and some toners will remain on the photosensitive drum. Therefore, the top surface of the photosensitive drum 1, after transfer of the toner image onto the paper, P is cleaned with the cleaner 6 to remove the residual toners. Then, the deelectrifying lamp 7 is activated to remove the residual charges on the photosensitive drum 1. The drum 1 is thus returned to the initial state to be ready for another printing operation.

The residual toners collected from the photosensitive drum 1 by the cleaner 6 are temporarily stored in a waste-toner tank by a toner carrying mechanism (not shown), and a user will dispose of this tank when a predetermined amount of waste toners is stored. This image forming process requires a toner disposal mechanism and space for storing the waste toners, and stands in the way of making the image forming apparatus compact. As the toners collected by the cleaner 6 do not contribute to printing, this process is not economical. Further, the toners require special handling during disposal to protect the environment.

In view of the above and due to the recent demands for smaller apparatuses and lower cost, it is desirable to eliminate part of the recording process. As one solution, a cleanerless process to eliminate the need for the cleaner has been proposed as in, for example, "Cleanerless Laser Printer," Electrophotographic Institute Report, vol. 30, no. 3, pp. 293–301.

This cleanerless process eliminates the cleaner 6 and allows the residual toners after image transfer to be collected by the developing device 4 so that the residual toners can be used again for printing. As shown in FIG. 1B, the cleaner 6 is eliminated and a conductive uniform brush 9 is provided instead in the cleanerless process. In this recording process, the residual toners on the photosensitive drum 1 are distributed by the brush 9. Then, the surface of the photosensitive drum 1 with toners thereon is uniformly charged by the corona charger 2, an image exposure is performed by the laser optical system 3, and the collection of the residual toners and developing of the electrostatic latent image are carried out simultaneously by the developing device 4.

The toners concentrating on one portion are distributed by the uniform brush 9 to reduce the amount of toners per unit area, thereby facilitating the toner collection by the developing device 4. Further, as the toners are distributed, the residual toners are prevented from becoming a filter for the ion shower from the corona charger 2 to thereby avoid non-uniform charging. Also, the toners in the exposing step are prevented from becoming a filter to thereby avoid uneven exposure.

The point of this recording process is the collection of the residual toners on the photosensitive drum 1 is performed at the same time as the developing step. This point will be described referring to FIG. 2A showing the photosensitive drum 1 charged to a negative potential with toners also charged to a negative potential. The surface potential of the photosensitive drum 1 is set to −500 to −1000 V, and the potential of that exposed portion where the potential drop has occurred due to the image exposure is dropped down to minus several tens of volts, thereby forming an electrostatic latent image. At the developing time, a developing bias potential lying nearly in the middle of the surface potential and the latent image potential is applied to a developing roller. In the developing step, the negatively-charged toners on the developing roller stick on the electrostatic latent image on the photosensitive drum 1 by an electric field formed by the developing bias potential and latent image potential, thereby providing a toner image.

In the cleanerless process, at the same time as the developing step is performed, the residual toners after image transfer, distributed over the photosensitive drum 1 by the uniform process, are collected to the developing roller from the surface of the drum 1 by the electric field that is created by the surface potential and the developing bias potential.

This cleanerless process apparently requires that the amount of the residual toners on the photosensitive drum 1 after collection in the developing device 4 be considerably small. Let us now consider the transfer step. When the corona discharger of an ordinary type is used as a transfer device, the charges given to the paper P by the corona discharge leak during periods of high humidity. Accordingly, an electric field may not be applied to the toners on the photosensitive drum 1, reducing the transfer efficiency. More specifically, the normal transfer efficiency of 80 to 90% drops to 50 to 60% at a high humidity. The reduction in transfer efficiency increases the quantity of the residual toners after image transfer. It therefore becomes difficult to completely collect the toners from the photosensitive drum 1 in the developing step, causing background noise to stick toners on the background of the paper. This reduces the print quality.

Let us now turn to the toners. Pulverized toners, which are normally used, have deformed shapes of uneven particle sizes. The pulverized toners therefore have a high mechanical adhesive strength to the photosensitive drum 1, making the toner transfer difficult. In addition, it becomes difficult to provide close contact of the toners with the paper in the transfer section. This weakens the electric field, reducing the transfer efficiency to 80 to 90%. Consequently, the quantity of the residual toners after transfer increases, making it difficult to completely collect the toners from the photosensitive drum 1 in the developing step. This also causes background noise to stick toners on the background of the paper, thus reducing the print quality.

Let us now consider the charging step. Most of the toners which are not transferred in the transfer step are those which have been charged to the opposite polarity. The oppositely charged toners will not be collected according to the principle of collecting the residual toners in the above-described developing step. This apparently causes background noise on the paper. The residual toners receive charged ions produced by the corona charger 2 in the charging step. While the photosensitive drum 1 is charged to a predetermined potential by the charged ions, the oppositely charged toners will not be charged to such a potential. The oppositely charged toners, even if charged by those ions, will keep the opposite polarity. This makes the toner collection difficult in the developing step. In addition, as shown in FIG. 2B, potential irregularity occurs on the surface of the photosensitive drum 1 after the transfer step. Even if the surface of the photosensitive drum 1 is uniformly charged in the charging step, this potential irregularity is likely to remain in that portion where the toners remain. This causes afterimage, background noise and the like, deteriorating the print quality.

SUMMARY OF THE INVENTION

It is therefore a primary object of the present invention to provide an image forming method and image forming apparatus, which improve the print quality in the cleanerless process.

It is another object of the present invention to provide an image forming method and image forming apparatus, which improve the transfer efficiency to thereby reduce the quantity of residual toners after image transfer in the cleanerless process. It is a further object of the present invention to provide an image forming method and image forming apparatus, which charge the oppositely charged toners remaining after image transfer to a positive potential and collect the residual toners in the developing step in the cleanerless process.

To achieve the foregoing and other objects in accordance with the purpose of the present invention, according to one aspect of the invention, an image forming apparatus comprises a rotary endless latent carrier; first means for charging the rotary endless latent carrier; second means for forming an electrostatic latent image on the rotary endless latent carrier; third means for developing the electrostatic latent image on the rotary endless latent carrier by supplying polymerization toners simultaneously with cleaning residual polymerization toners on the rotary endless latent carrier; and fourth means for transferring the polymerization toners on the rotary endless latent carrier to a sheet.

An image forming method according to this aspect comprises a first step of charging a rotary endless latent carrier; a second step of forming an electrostatic latent image on the rotary endless latent carrier; a third step of developing the electrostatic latent image on the rotary endless latent carrier by supplying polymerization toners simultaneously with cleaning residual polymerization toners on the rotary endless latent carrier; and a fourth step of transferring the polymerization toners on the rotary endless latent carrier to a sheet.

As the polymerization toners have a smooth shape, the mechanical adhesive strength of attachment to the latent carrier is small. It is therefore easier to transfer the toners on a sheet, thus improving the transfer efficiency. Further, since the polymerization toners have an even particle size, the clearance between the latent carrier and the sheet becomes smaller so that the electric field for image transfer can be applied to the toners with high efficiency, thus improving the transfer efficiency. This reduces the quantity of the residual toners after image transfer and facilitates the collection of the residual toners in the developing device.

To achieve the foregoing objects, according to another aspect of the invention, an image forming apparatus comprises a rotary endless latent carrier; first means for charging the rotary endless latent carrier; second means for forming an electrostatic latent image on the rotary endless latent carrier; third means for developing the electrostatic latent image on the rotary endless latent carrier by supplying toners simultaneously with cleaning residual toners on the rotary endless latent carrier; fourth means having a rotary transfer roller for transferring the toners on the rotary endless latent carrier to a sheet by sandwiching the sheet between the rotary endless latent carrier and the rotary transfer roller; and fifth means for electrifying the rotary transfer roller.

An image forming method according to this aspect comprises a first step of charging a rotary endless latent carrier; a second step of forming an electrostatic latent image on the rotary endless latent carrier; a third step of developing the electrostatic latent image on the rotary endless latent carrier by supplying toners simultaneously with cleaning residual toners on the rotary endless latent carrier; and a fourth step of transferring the toners on the rotary endless latent carrier to a sheet by sandwiching the sheet between the rotary endless latent carrier and a rotary transfer roller to be electrified for transfer operation.

According to this aspect, the transfer step is performed by the transfer roller. In the conventional transfer involving a corona charger, charges supplied to the sheet by the corona discharger at a high humidity leak so that an electric field will not be applied to the toner image. This is because the supplied charges leak to the apparatus assembly through the sheet which has absorbed water in the air, dropping the electric resistance. Consequently, the transfer efficiency falls and increases the quantity of the residual toners after image transfer, making it difficult to collect the residual toners in the developing device. When the transfer roller is used, on the contrary, the transfer roller closely contact the sheet and serves as an electrode, permitting the charges to be supplied directly to the sheet. Even if some charges leak, the electric field does not decrease much. Further, since pressure and electrostatic force are used, a stable transfer efficiency can always be obtained regardless of a variation in environmental conditions. It is thus possible to reduce the quantity of the residual toners after image transfer, thus ensuring a cleanerless process which facilitates and stabilizes toner collection in the developing device.

To achieve the foregoing objects, according to a further aspect of the invention, an image forming apparatus comprises a rotary endless latent carrier; first means having a rotary charging brush for charging the rotary endless latent carrier; second means for forming an electrostatic latent image on the rotary endless latent carrier; third means for developing the electrostatic latent image on the rotary endless latent carrier by supplying toners simultaneously with cleaning residual toners on the rotary endless latent carrier; fourth means for transferring the toners on the rotary endless latent carrier to a sheet; and fifth means for supplying a charging voltage to the rotary charging brush.

An image forming method according to this aspect comprises a first step of charging a rotary endless latent carrier by a rotary charging brush applied with a charging voltage; a second step of forming an electrostatic latent image on the rotary endless latent carrier; a third step of developing the electrostatic latent image on the rotary endless latent carrier by supplying toners simultaneously with cleaning residual toners on the rotary endless latent carrier; and a fourth step of transferring the toners on the rotary endless latent carrier to a sheet.

According to this aspect, as the rotary endless latent carrier is charged by the charging brush, the charging brush contacts the residual toners on the latent carrier. Accordingly, the residual toners are charged through friction and supplied with charges from the charging brush. This causes the oppositely charged toners to be charged to a positive potential, thus ensuring toner collection in the developing step. As the charging brush is rotated to charge the latent carrier, the residual toners are paddled temporarily and the charging is carried out while putting the paddled toners again onto the latent carrier. Even if there are residual toners after image transfer, therefore, uneven charging can be prevented and the residual toners can be distributed, thus ensuring stable uniform charging. Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1A:
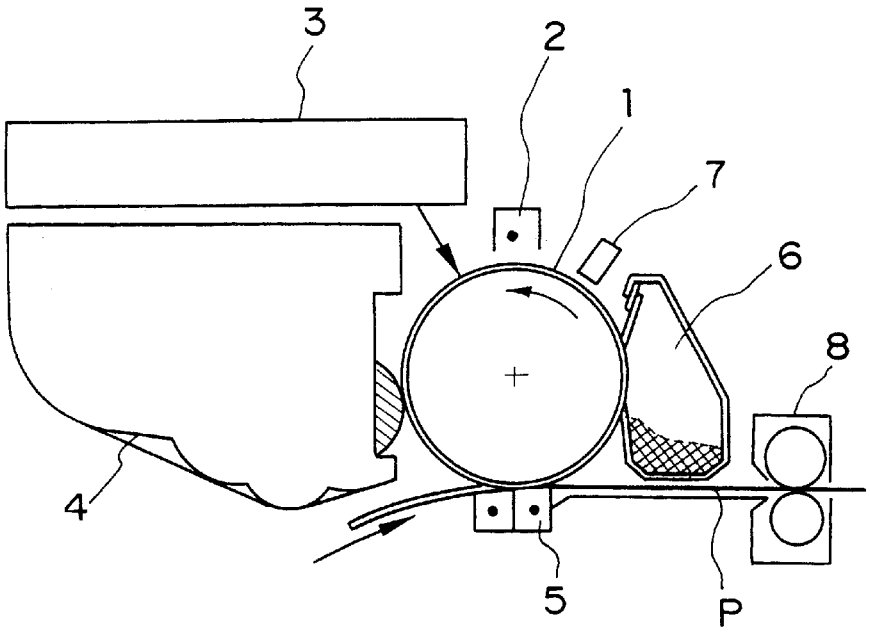
Fig. 1A PRIOR ART
FIGS. 1A, 1B, 2A and 2B are diagrams for describing prior art.
Figure 1B:
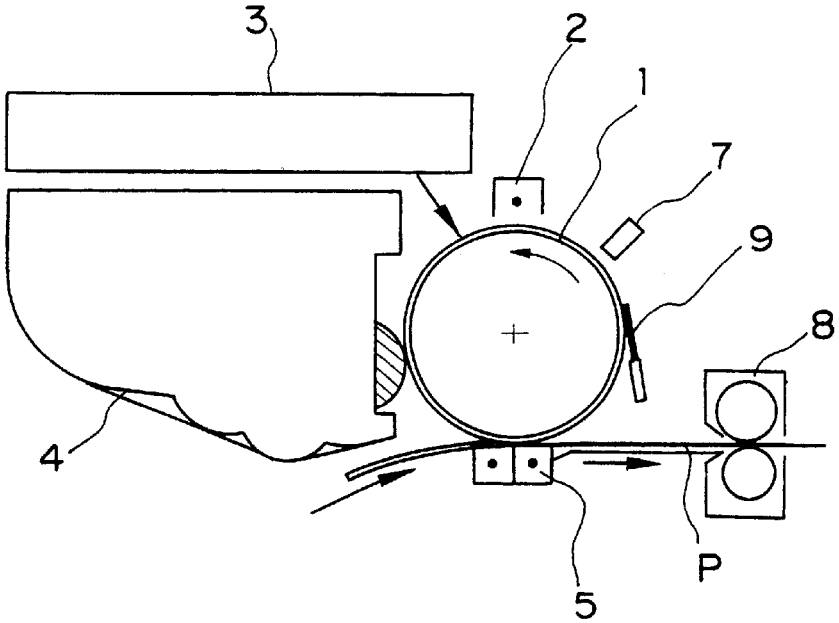
Fig. 1B PRIOR ART
Figure 2A:
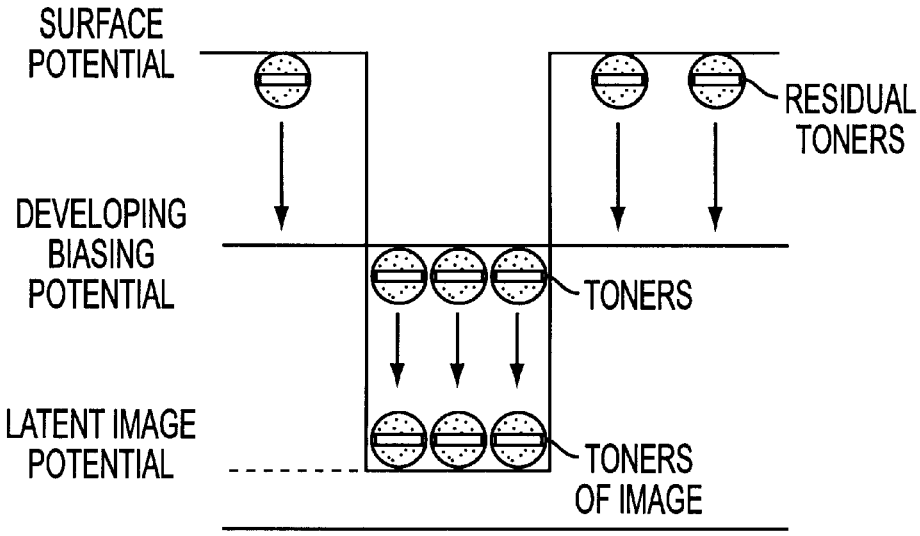
FIG. 2A (PRIOR ART)
Figure 2B:
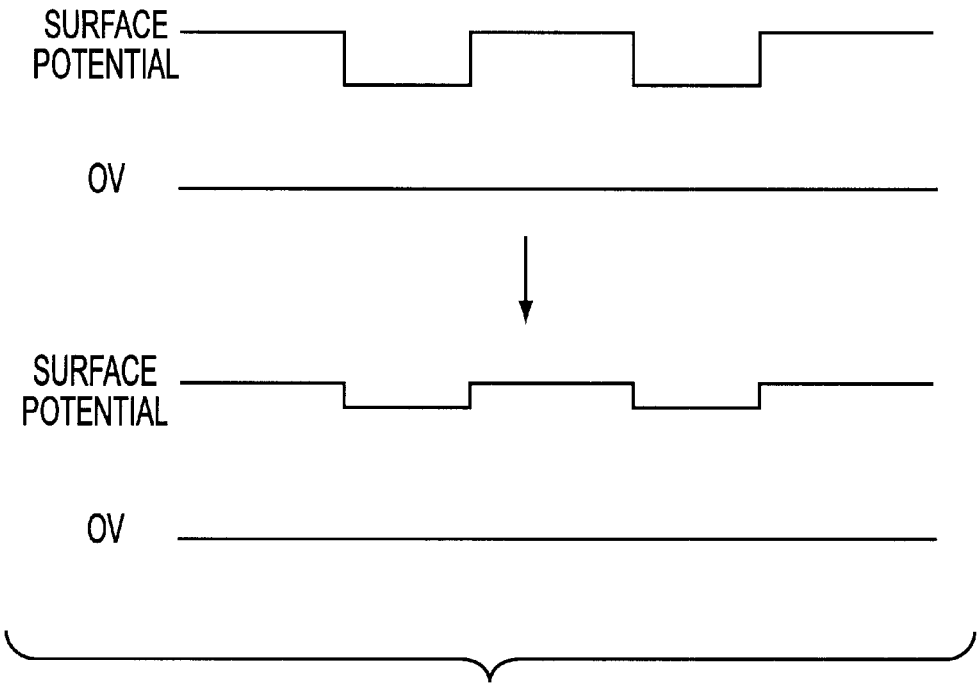
FIG. 2B (PRIOR ART)
Figure 3:
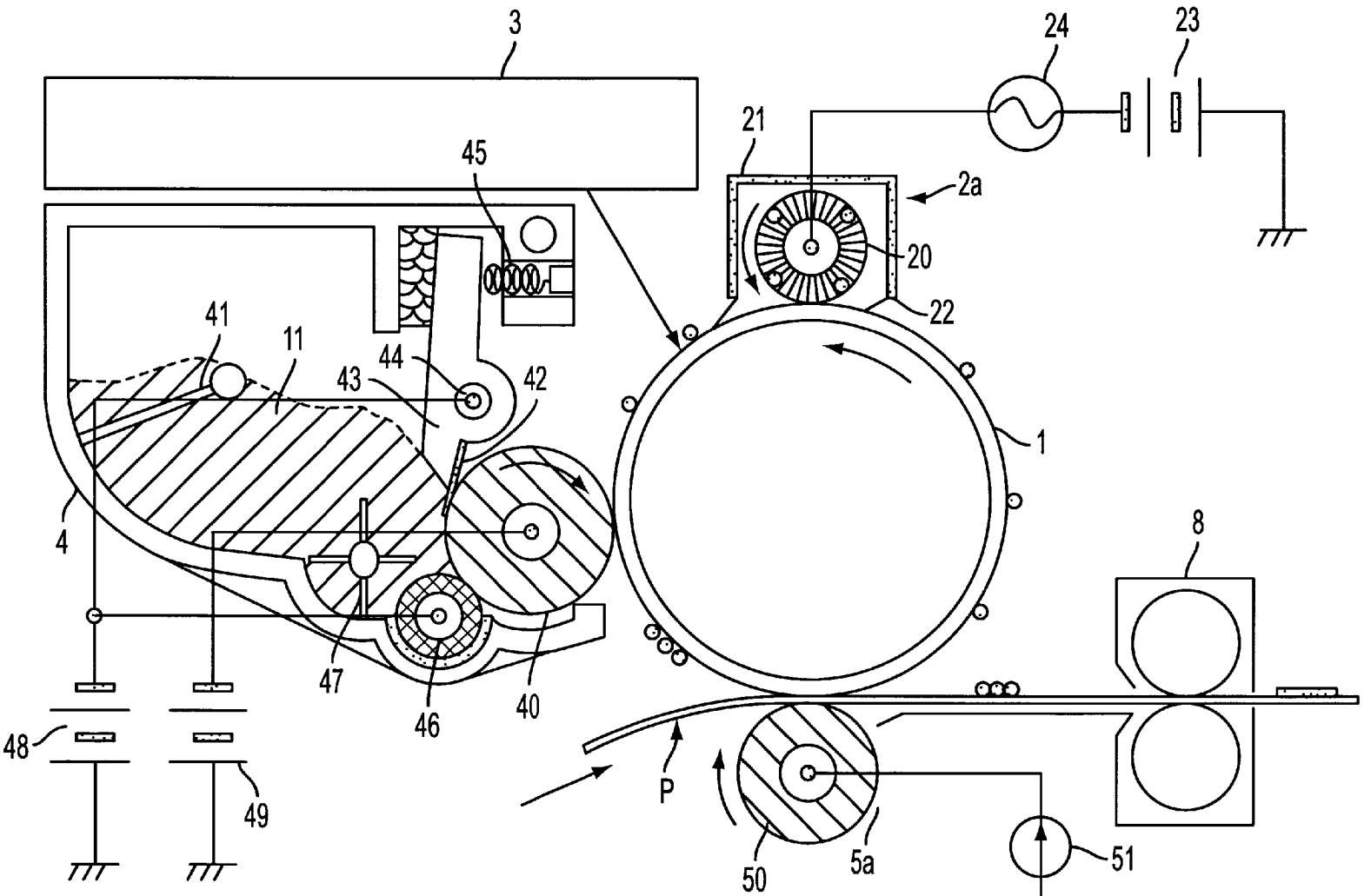
FIG. 3 is a diagram showing the structure of a printer according to one embodiment of the present invention.
Figure 4:
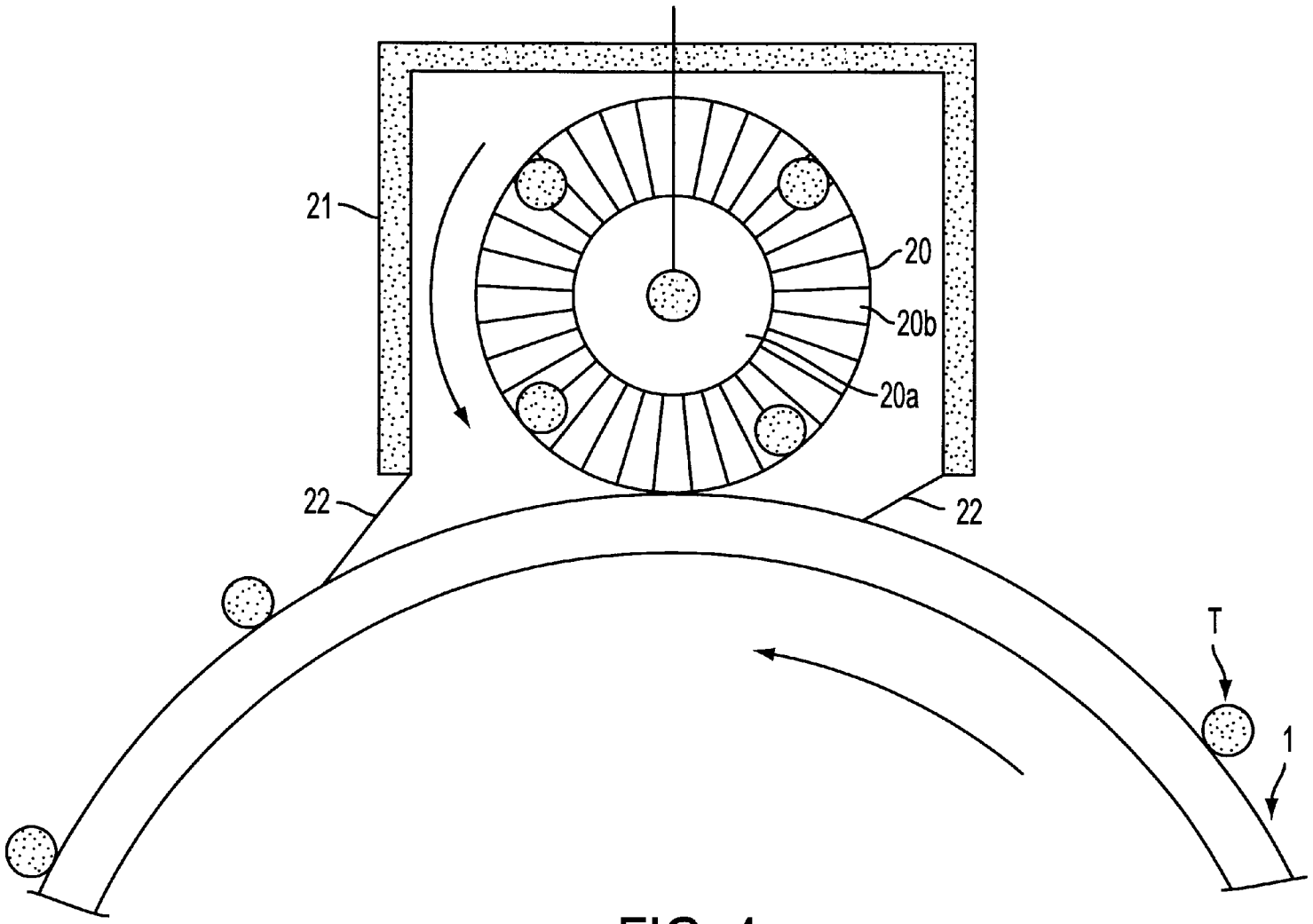
FIG. 4 is a diagram showing the structure of a brush charger in the printer in FIG. 3.

FIG. 3 illustrates the structure of a printer according to one embodiment of the present invention, and FIG. 4 shows the structure of a brush charger in this printer.

Referring to FIG. 3, a photosensitive drum 1 is an aluminum drum on which a functionally separate organic photosensitive body is coated about 20 microns thick. This photosensitive drum 1 has an outside diameter of 40 mm and rotates at a peripheral speed of 70 mm/s in the counterclockwise direction indicated by the arrow. A rotary brush charger 2*a* has a charging brush 20 which comes in contact with the surface of the photosensitive drum 1. This charging brush 20 is constituted of a conductive fur brush which is rotated counterclockwise (in the arrow direction) by a driving source (not shown). An AC power source 24 and a DC constant power source 23 are connected to this charging brush 20.

As shown in FIG. 4, a housing 21 is provided to cover the charging brush 20 and prevent toners from sputtering.

Further, resin films 22 are provided on the housing 21 at the inlet and outlet sides of the photosensitive drum 1. The films 22 serve to prevent toner leakage from the housing 21 to contaminate the interior of the printer.

The charging brush 20 has a stainless shaft 20*a* as its base and a belt-shaped cloth with standing fibers wound around the stainless shaft 20*a* in a spiral form without clearance, forming a roll of a brush fiber layer 20*b*. In this embodiment, the brush fiber layer 20*b* is set to 5 mm high so that the outside diameter of the brush becomes 16 mm. Brush fibers

20*b* are given conductivity by dispersing carbon particles into rayon fibers. The resistance of the brush fibers 20*b* was selected to be $10^9\Omega$ per fiber. The rotational speed of the charging brush 20 was set to 1.6 times that of the photosensitive drum 1.

The DC constant power source 23 has a voltage of −700 V. The AC power source 24 has a voltage between peaks of 1200 V and a frequency of 800 Hz. Accordingly, the surface of the photosensitive drum 1 is charged to −700 V.

Laser optical system 3 is a well-known type which exposes the photosensitive drum 1 to light in accordance with an image pattern to form an electrostatic latent image. The potential of the latent image portion becomes −50 to −100 V.

A developing device 4 is constituted of a one-component developing unit. This developing device has a developing roller 40, which rotates around a metallic shaft to supply non-magnetic insulating toners 11 to the electrostatic latent image on the photosensitive drum 1. The toners 11 are spherical polymerization toners with a volume resistivity of $4\times10^{14}$ Ω19 cm and an average particle size of 11 μm. As an additive, 0.5% of silica is added to the toners 11.

The developing roller 40 in use is a porous urethane sponge (product name "Rubicell" from TOYO POLYMER CO., LTD.) with an average porous size of 10 μm, volume resistivity of $10^4$ Ω·cm to $10^7$ Ω·cm and a hardness of about 30° (Ascar C penetrometer). The developing roller 40 has an outside diameter of 20 mm and its peripheral speed is set to 2.5 times that of the photosensitive drum 1.

A layer-thickness restricting blade 42 is a stainless plate of a thickness of 0.1 mm with the tip rounded to have R=0.05 mm at the tip portion. A blade holder 43 is pivotable around a fulcrum 44. The blade holder 43 has one end to which the layer-thickness restricting blade 42 is fixed, and the other end applied with pressure toward the developing roller 40 by a coil spring 45. This pressure is so set that this blade 42 exerts force of 30 fg/cm to the developing roller 40.

A reset roller 46 is provided to collect toners remaining on the developing roller 40 after the electrostatic latent image on the photosensitive drum 1 is developed and supply the toners 11 to the developing roller 40. This reset roller 46 therefore has a function to help make the toners 11 on the developing roller 40 into a layer of a uniform thickness. The reset roller 46 in use is an ester-base urethane sponge (product name "Everite SK-E" from BRIDGESTONE CORPORATION) with a volume resistivity of $10^4$ Ω·cm. The peripheral speed of the reset roller 46 is set to 228 mm/s, about 1.3 times that of the developing roller 40.

Paddle rollers 41 and 47, both made of a resin, serve to move the toners to the vicinity of the developing roller 40.

Reference numerals "48" and "49" denote DC power sources. The DC power source 49 applies a developing bias voltage to the developing roller 40 and its voltage is set to −350 V, about the middle of the surface potential of the photosensitive drum 1, −700 V, and the latent image potential (−50 V to −100 V). The DC power source 48 applies a voltage to the layer-thickness restricting blade 42 and reset roller 46 and its voltage is set to −450 V. There is a potential difference of 100 V between the layer-thickness restricting blade 42 and the developing roller 40 and between the reset roller 46 and the developing roller 40.

As the toners 11 pass between the developing roller 40 and the layer-thickness restricting blade 42, therefore, charges are given to the toners 11 by the frictional charging caused between the toners 11 and the blade 42. At the same time, the potential difference given between the developing roller 40 and the blade 42 permits charges to be supplied to the toners 11 from the blade 42. That is, the toners 11 are supplied with charges by the frictional charging and the latter charge supply. Therefore, the dependency of the amount of the charges of the toners 11 to the environment is small, allowing a uniform toner image with a lasting stability to be formed on the developing roller 40.

Under the aforementioned conditions, the toners 11 are charged negatively, and the potential difference between the reset roller 46 and the developing roller 40 is capable of electrically supplying negatively-charged toners 11 to the developing roller 40.

The above-described developing device 4 is pressed against the photosensitive drum 1 with pressure of 30 gf/cm to execute in-contact developing.

A roller transfer device 5*a* has a transfer roller 50 constituted by lining a conductive foaming body of the same material as that of the developing roller 40, as a conductive elastic layer, around a stainless shaft. This transfer roller 50 has an outside diameter of 20 mm and rotates at the same peripheral speed as the photosensitive drum 1. Further, pressure of 30 gf/cm toward the photosensitive drum 1 is applied to the transfer roller 50 by a pressing mechanism (not shown). A constant current source 51 for supplying a constant current is connected to this transfer roller 50 to supply a predetermined amount of charges to a sheet of paper P. To electrostatically transfer the toner image on the photosensitive drum 1 onto the paper P, charges of the opposite polarity to that of the charges of the toners or a positive bias due to the negatively-charged toners in this embodiment is applied to the transfer roller 50 by the constant current source 51. The electrostatic transfer is combined with pressure transfer which presses the transfer roller 50 against the photosensitive drum 1.

A fixing device 8 heats the toner image by means of a heat roller having a halogen lamp incorporated therein to thereby fix the image on the paper P.

The operation of this embodiment will be described below. After the surface of the photosensitive drum 1 is evenly charged to −700 V by the brush charger 2*a*, image exposure is performed by the laser optical system 3 to form an electrostatic latent image with the background portion charged to −700 V and the exposed portion charged to −50 to −100 V, on the photosensitive drum 1. The electrostatic latent image on the photosensitive drum 1 is developed by spherical polymerization toners 11, which have previously been charged negatively, in the one-component developing device 4, yielding a toner image. Then, the toner image on the photosensitive drum 1 is transferred onto the paper P through pressure and electrostatic force by the roller transfer device 5*a*. At this time, since the transfer roller 50 serves as an electrode in close contact with the paper P and toner image and the transfer system involves both electrostatic transfer and pressure transfer, the transfer efficiency will not drop even at high humidity. In addition, due to the use of the spherical polymerization toners 11, the paper P comes in close contact with the toner image on the photosensitive drum 1 so that the electric field of the transfer roller 50 can effectively act to improve the transfer efficiency, thus reducing the quantity of residual toners after transfer.

The toner image on the paper P is fixed by the fixing device 8. As the charging brush 20 of the brush charger 2*a* rotates, the toners remaining on the photosensitive drum 1 after transfer are separated therefrom and charged to stick on the photosensitive drum 1 again. At this time, the charging brush 20 of the brush charger 2*a* contacts the residual toners on the photosensitive drum 1. This causes the residual toners to be frictionally charged and to be supplied with charges from the charging brush 20. Even if the residual toners are charged to the opposite potential, therefore, the toners will be charged properly. Further, the photosensitive drum 1 is charged after the residual toners are separated therefrom, thus preventing uneven charging of the photosensitive drum 1. The residual toners are also distributed over the photosensitive drum 1, thus facilitating toner collection by the developing device 4.

Thereafter, image exposure is performed by the laser optical system 3 to form a latent image, and collection of the residual toners and development of the latent image with toners are carried out by the developing device 4.

Figure 5:
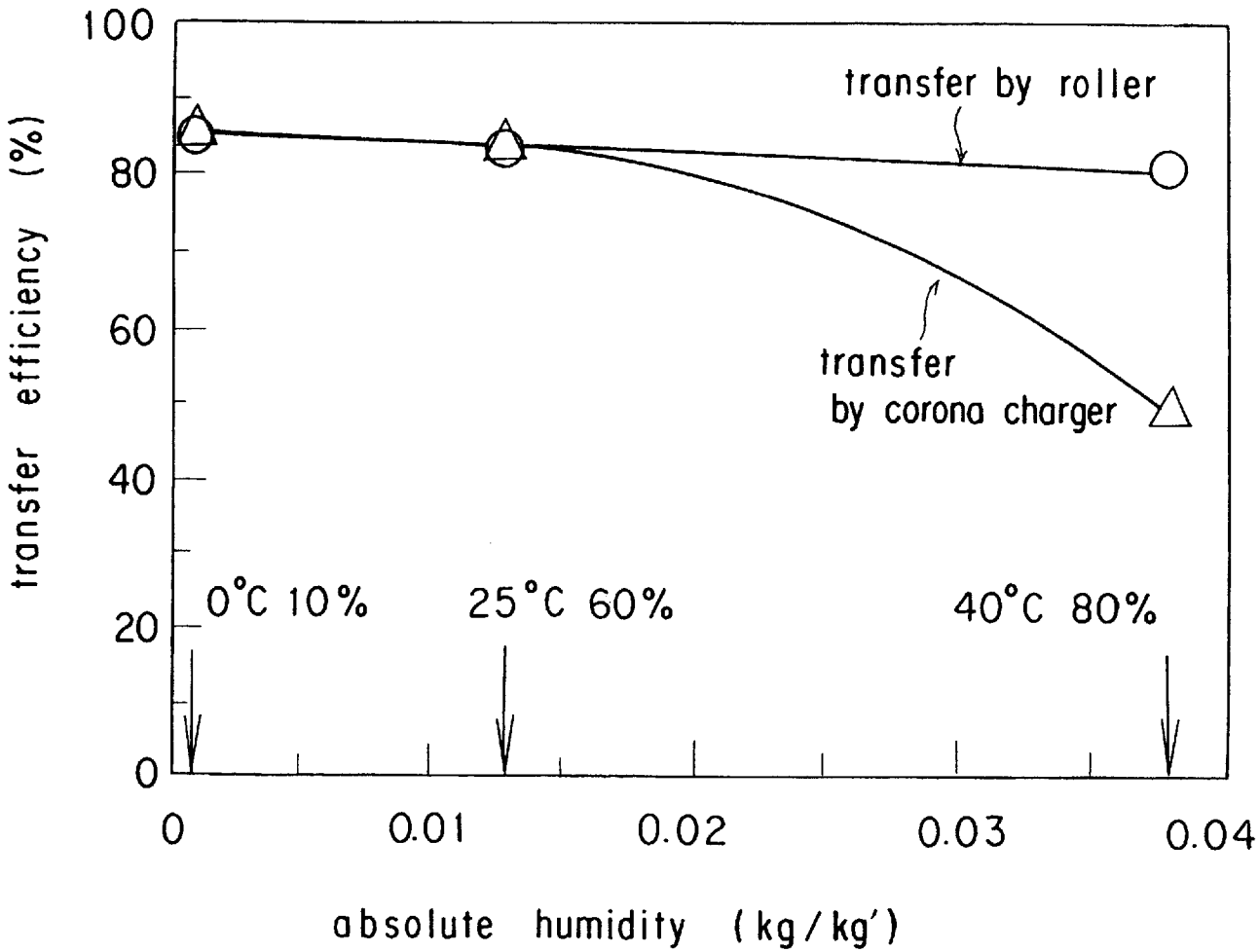
FIG. 5 is a diagram showing a transfer efficiency characteristic of a transfer roller in the printer in FIG. 3.

FIG. 5 illustrates the characteristic of the transfer roller of the present invention. The horizontal scale in FIG. 5 represents the absolute humidity, and the vertical scale the transfer efficiency. As apparent from the results of the comparison between the transfer efficiency of the conventional transfer by corona discharge and that of transfer by the transfer roller of this invention, as the absolute humidity varies, the transfer efficiency is 80% or higher at the normal temperature and the normal humidity (25° C., 60%) in the conventional transfer by corona discharge indicated by the triangular mark, but drops down to about 50% at a high humidity. In contrast, the transfer efficiency by the roller transfer of the present invention is above 80% and hardly changes in the temperature and humidity range from 0° C. at 10% to 4° C. at 80% as indicated by circular marks in the diagram.

It seems that hardly no change occurs in the present invention because the transfer roller 50 serves as an electrode in close contact with the paper P and toner image and the transfer system involves both electrostatic transfer and pressure transfer, as described earlier. Even at a high temperature and high humidity, the transfer efficiency will not drop and the quantity of the residual toners will not increase, so that the cleanerless process can be executed stably.

A description will now be given of polymerization toners. Styrene-acrylic base polymerization toners are used as non-magnetic polymerization toners in the present invention. An example of such toners is available from NIPPON ZEON CO., LTD. Polymerization toners are toners which are prepared by emulsion polymerization or suspension polymerization as disclosed in, for example, "Functional Materials," a monthly magazine, October 1990, pp. 25–30. For instance, in the suspension polymerization method, monomer, coloring material or the like is dispersed into water for suspension polymerization, yielding toners. The polymerization toners are characterized by their smooth surface and sharp particle distribution.

Figure 8:
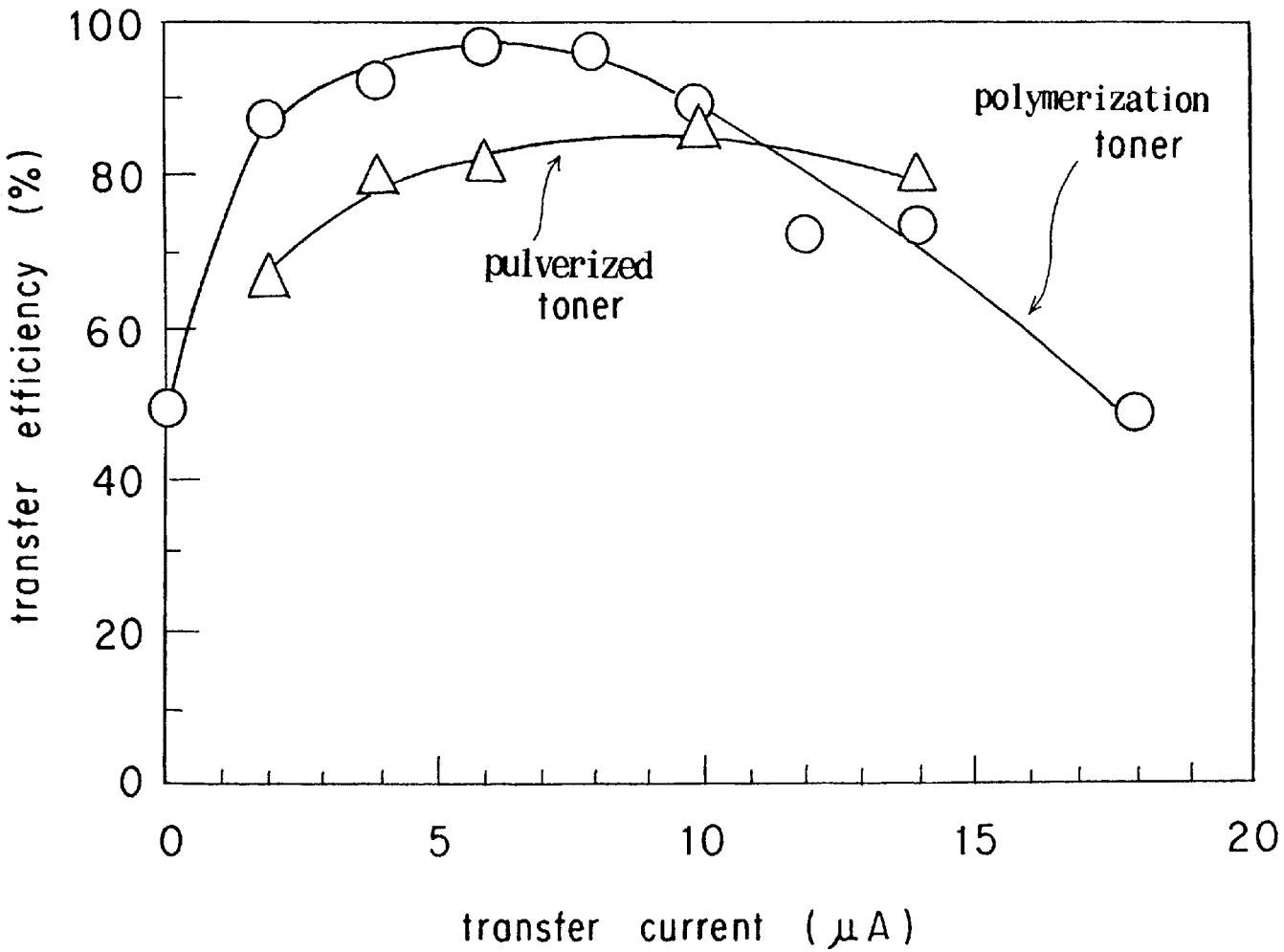
FIG. 8 is a diagram showing transfer efficiency characteristics of polymerization toners and pulverized toners.
Figure 9A:
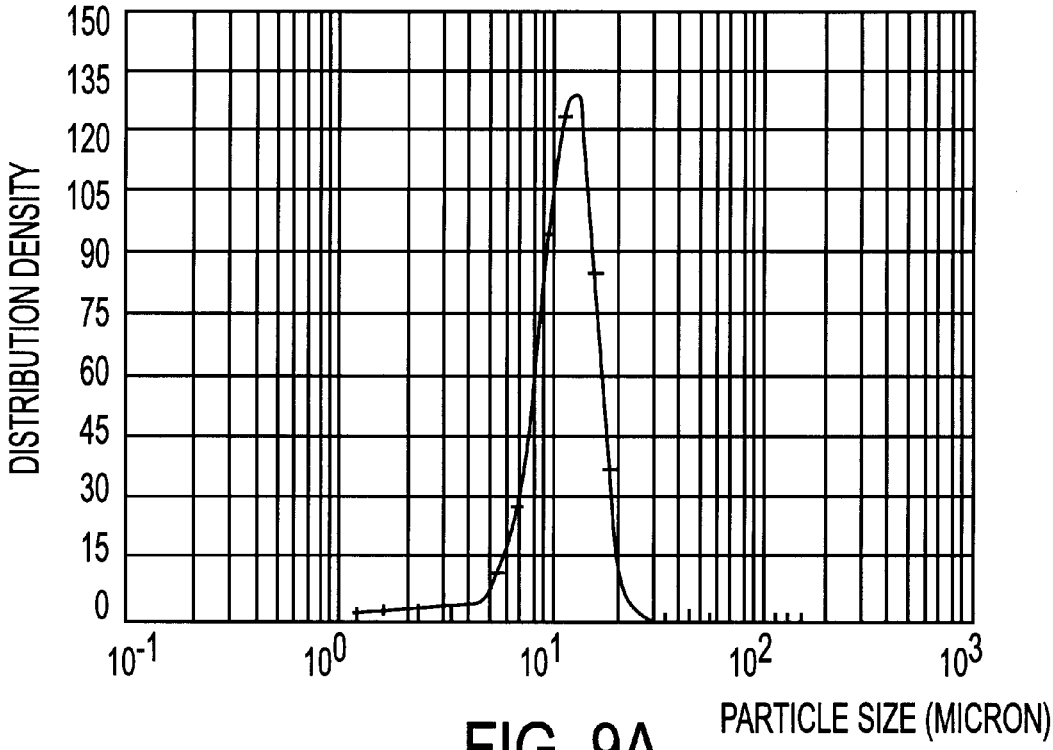
FIG. 9A (PRIOR ART)
FIG. 9A is a diagram showing the distribution of pulverized toners according to the prior art.
Figure 9B:
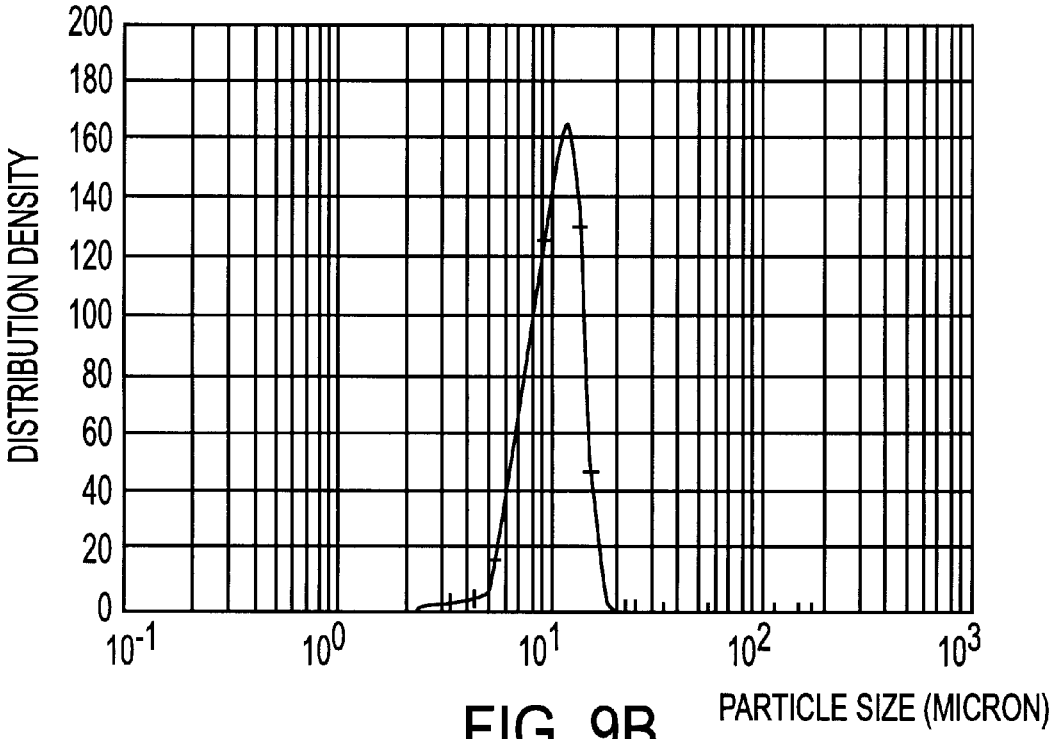
FIG. 9B is a diagram showing the distribution of polymerization toners according to the present invention.

FIG. 8 illustrates the comparison between the transfer efficiency with pulverized toners in the prior art and that with the polymerization toners according to the present invention. As apparent from FIG. 8, when the current flowing through the transfer roller 50 varies, the highest transfer efficiency is 82% for the conventional case of using pulverized toners, whereas the highest transfer efficiency with the use of polymerization toners as in the present invention is 96%, higher than the conventional value. The particle distributions of the toners used in this evaluation are illustrated in FIGS. 9A and 9B. The particle distribution of polymerization toners shown in FIG. 9B is sharper than that of pulverized toners shown in FIG. 9A, indicating that the polymerization toners have closer particle sizes.

Figure 6A:
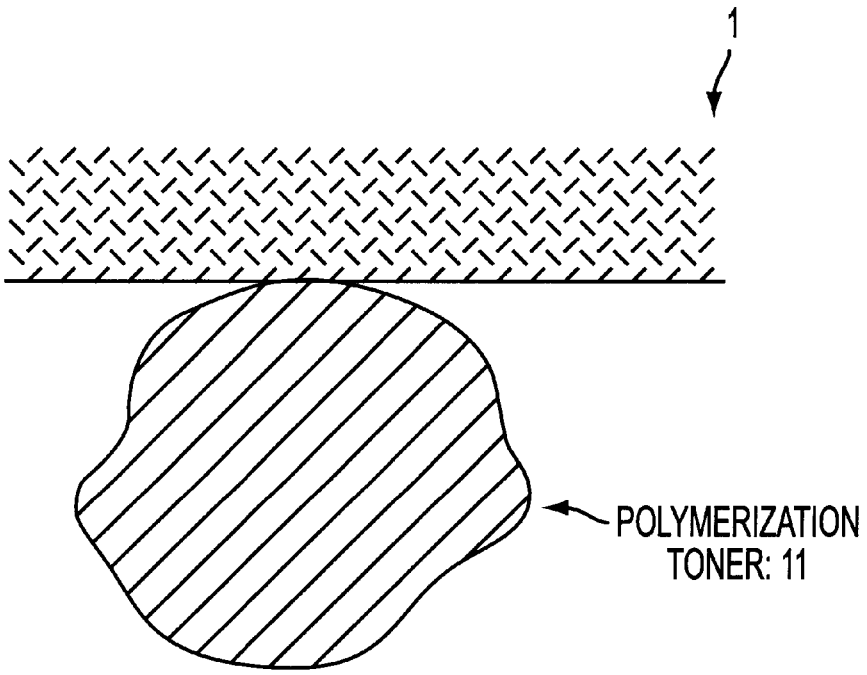
FIG. 6A is a diagram illustrating the state of polymerization toners with respect to a photosensitive drum in the printer in FIG. 3.
Figure 6B:
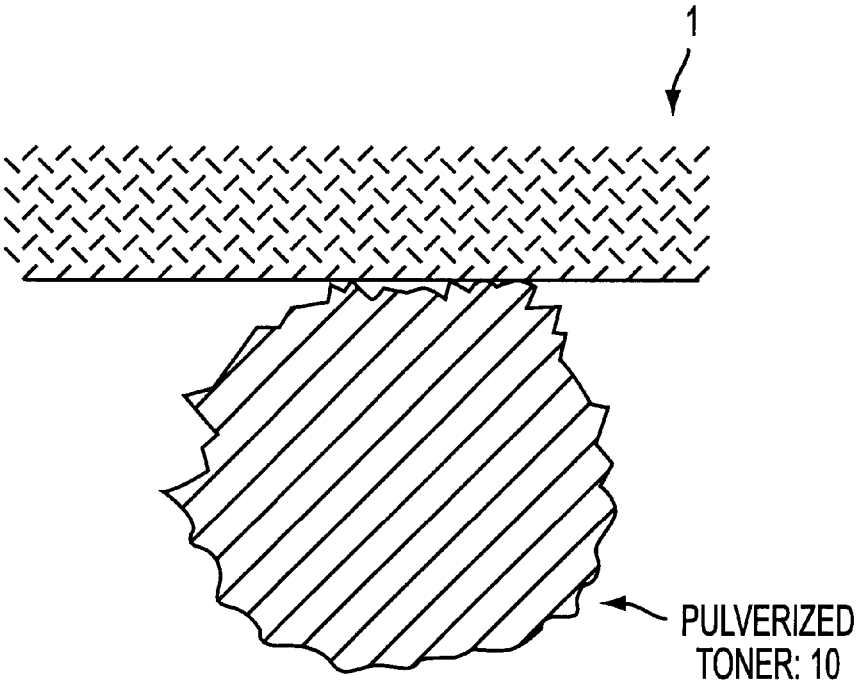
FIG. 6B (PRIOR ART)
FIG. 6B is a diagram illustrating the state of pulverized toners with respect to a photosensitive drum according to the prior art.
Figure 7A:
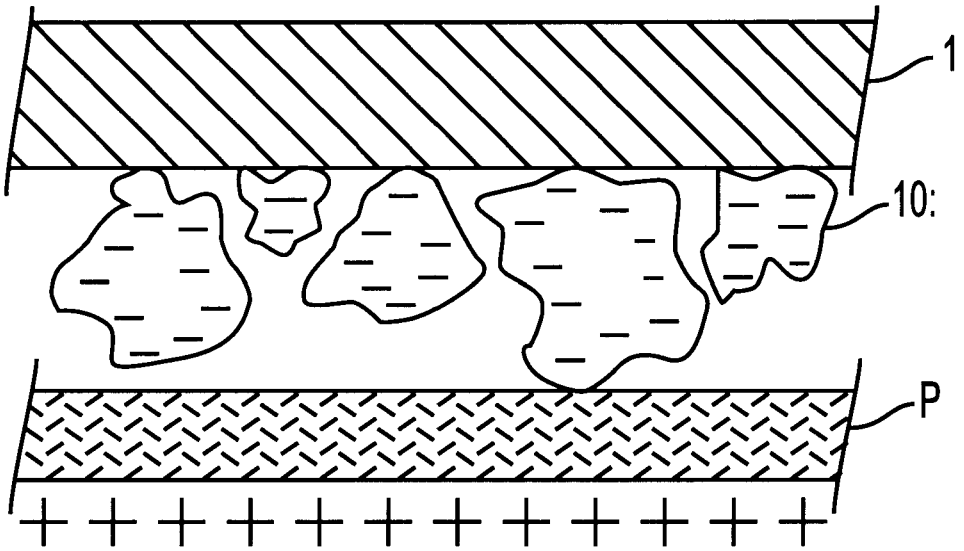
FIG. 7A (PRIOR ART)
FIG. 7A is a diagram illustrating a conventional transfer step involving pulverized toners.
Figure 7B:
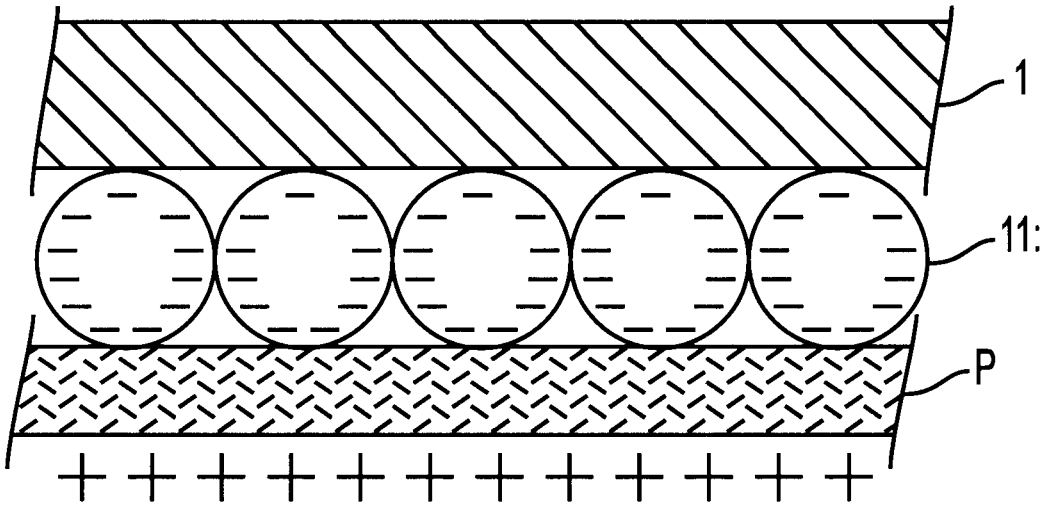
FIG. 7B (PRIOR ART)
FIG. 7B is a diagram illustrating a conventional transfer step involving polymerization toners.

This difference may have resulted from the following reasons. First, because of smooth surfaces of the polymerization toners 11 as shown in the model diagram of polymerization toners in FIG. 6A, the mechanical adhesive strength (van der Waals force) to the photosensitive drum 1 is small, so that transfer of a toner image to a sheet is easier, thus improving the transfer efficiency. On the other hand, the pulverized toners have rough surfaces as shown in FIG. 6B, yielding stronger mechanical adhesive strength to the photosensitive drum 1, so that the transfer efficiency is low. Secondly, the particle distribution of the pulverized toners 10 is wide as described above (see the model of transfer of pulverized toners in FIG. 7A), a clearance is likely to be formed between the paper P and the toner image, thus weakening the transfer electric field. The polymerization toners 11 have a narrower particle distribution as indicated by the transfer model of polymerization toners in FIG. 7B, a clearance is not easily formed between the paper P and the toner image as described earlier. The transfer electric field is effectively applied, thus improving the transfer efficiency.

In short, the use of the transfer roller and the spherical polymerization toners can improve the transfer efficiency and reduce the quantity of the residual toners after transfer, facilitating the toner collection in the developing step so that a stable cleanerless process can be accomplished.

The brush charger 2*a* used in the charging step will now be described. As described above, the charging brush contacts the residual toners on the photosensitive drum 1 to frictionally charge the residual toners and supply charges to those residual toners. As a result, the oppositely-charged toners are charged to be the properly-charged toners. The oppositely-charged toners can therefore be collected smoothly by the aforementioned potential difference in the developing step. The brush fibers 20*b* of the charging brush 20 should be capable of exchanging electrons. Here this ability is defined by the surface level density that represents the quantity of electrons a material has on its surface. For the aforementioned negatively-charged toners, to effectively reduce the residual toners on the photosensitive drum 1 that cannot be collected in the developing step, the surface level density of the brush fibers 20*a* should be at least $4\times10^{8}ev^{-1}\cdot^{-2}$. For example, conductive fibers (product name "REC-A" from TOEI INDUSTRY CO., LTD.) may serve as the brush fibers.

As the brush charger 2*a* scrapes the residual toners on the photosensitive drum 1 after transfer and charges this drum 1, uneven charging of the drum 1 can be prevented. Further, the residual toners after transfer can be distributed over the photosensitive drum 1, thus facilitating the toner collection in the developing step.

This helps accomplishing the cleanerless process which has no uniform step by the uniform brush 9 and no deelectrifying step.

Figure 10:
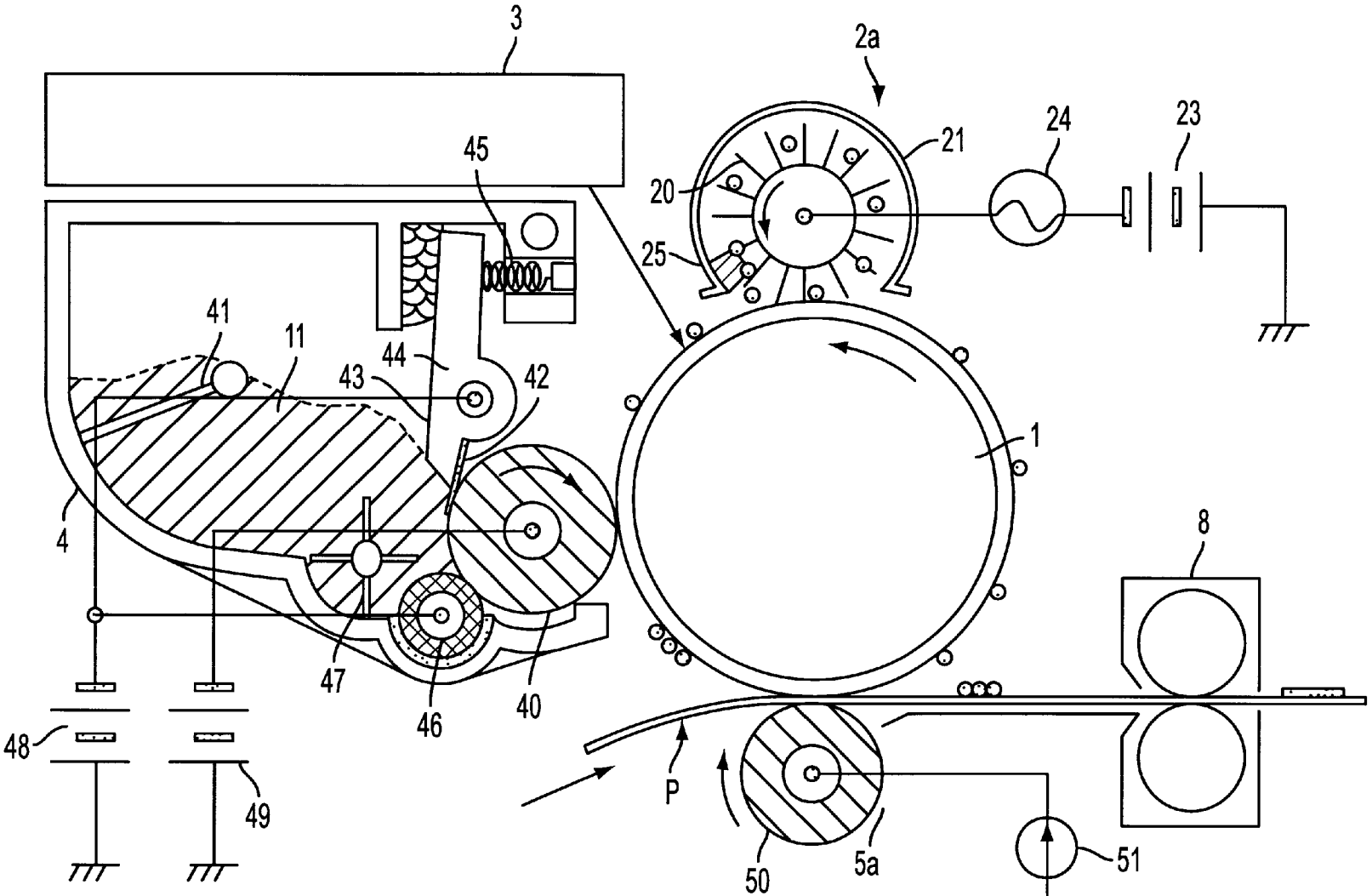
FIG. 10 is a diagram illustrating the structure of a printer according to another embodiment of the present invention.
Figure 11:
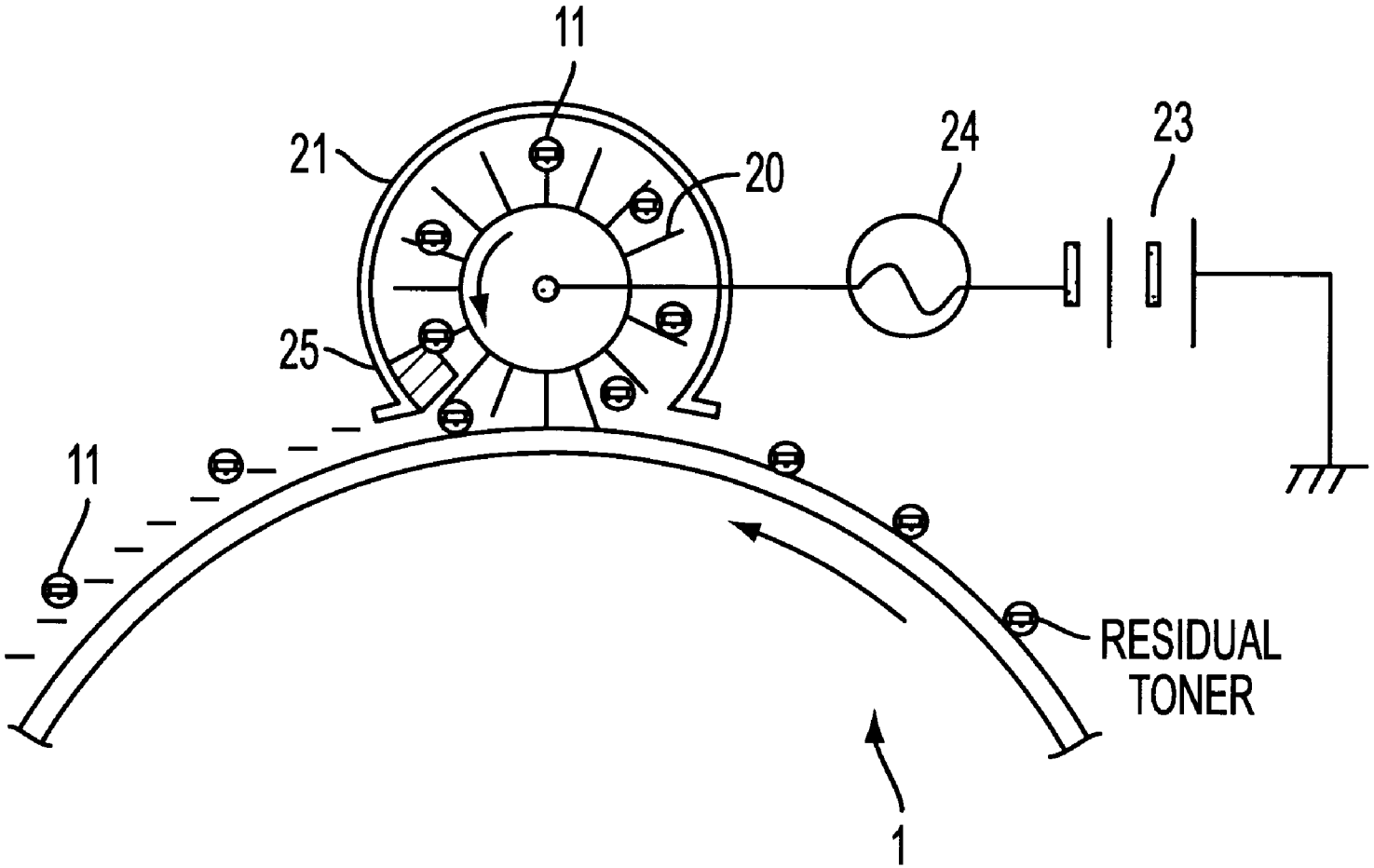
FIG. 11 is a diagram for explaining the operation of a brush charger in the printer of FIG. 10.

FIG. 10 shows the structure of a printer according to a modification of the above-described embodiment of the present invention, and FIG. 11 presents a diagram for explaining the operation of a brush charger shown in FIG. 10.

In FIG. 10, same or like reference numerals are given to those components which correspond to or are identical to those shown in FIG. 3. A projection 25 is provided on the housing 21 of the brush charger 2*a* to clean off the toners sticking on the charging brush 20. This embodiment therefore has the structure of FIG. 3 to which the projection 25 is additionally provided on the housing 21.

The operation of this embodiment will be described referring to FIG. 11. The residual toners on the photosensitive drum 1 after transfer should be scraped by the charging brush 20 of the brush charger 20*a* and should come off from the brush 20, as described in the earlier section of the previous embodiment referring to FIG. 3. But, some toners may remain stuck on the charging brush due to the electrostatic force of the brush 20 and the toners, or the like. A large amount of toners will accumulatively stick on the charging brush 20 when several thousand to several scores of thousand sheets of paper are to be printed. Consequently, charges cannot be supplied to the photosensitive drum 1 from the charging brush 20, and the surface potential will drop, resulting in uneven charging. The reduction in the surface potential and uneven charging of the photosensitive drum 1 will raise a printing problem, such as background noise, reducing the print quality.

To avoid this problem, the projection 25 which comes in contact with the charging brush 20 is provided on the housing 21 that prevents sputtering of toners, so that those toners sticking on the charging brush 20 hit against the projection 25 to be brushed off onto the photosensitive drum 1.

To smoothly drop the toners on the photosensitive drum 1, it is desirable that the projection 25 be provided at the opening portion of the housing 21 and downstream in the rotational direction of the photosensitive drum 1.

If the charging brush 20 is disposed above the horizontal line that passes through the rotational center of the photosensitive drum 1, the toners separated from the charging brush 20 by the projection 25 stick on the drum 1 due to the dead weight. It is therefore possible to prevent the separated toners from sticking to or sputtering to other than the surface of the photosensitive drum 1.

With the above structure, therefore, even when the charging brush 20 scrapes the residual toners on the photosensitive drum 1, it is possible to prevent the toners from accumulating on the charging brush 20 and reducing the charging performance of the brush 20.

Figure 12:
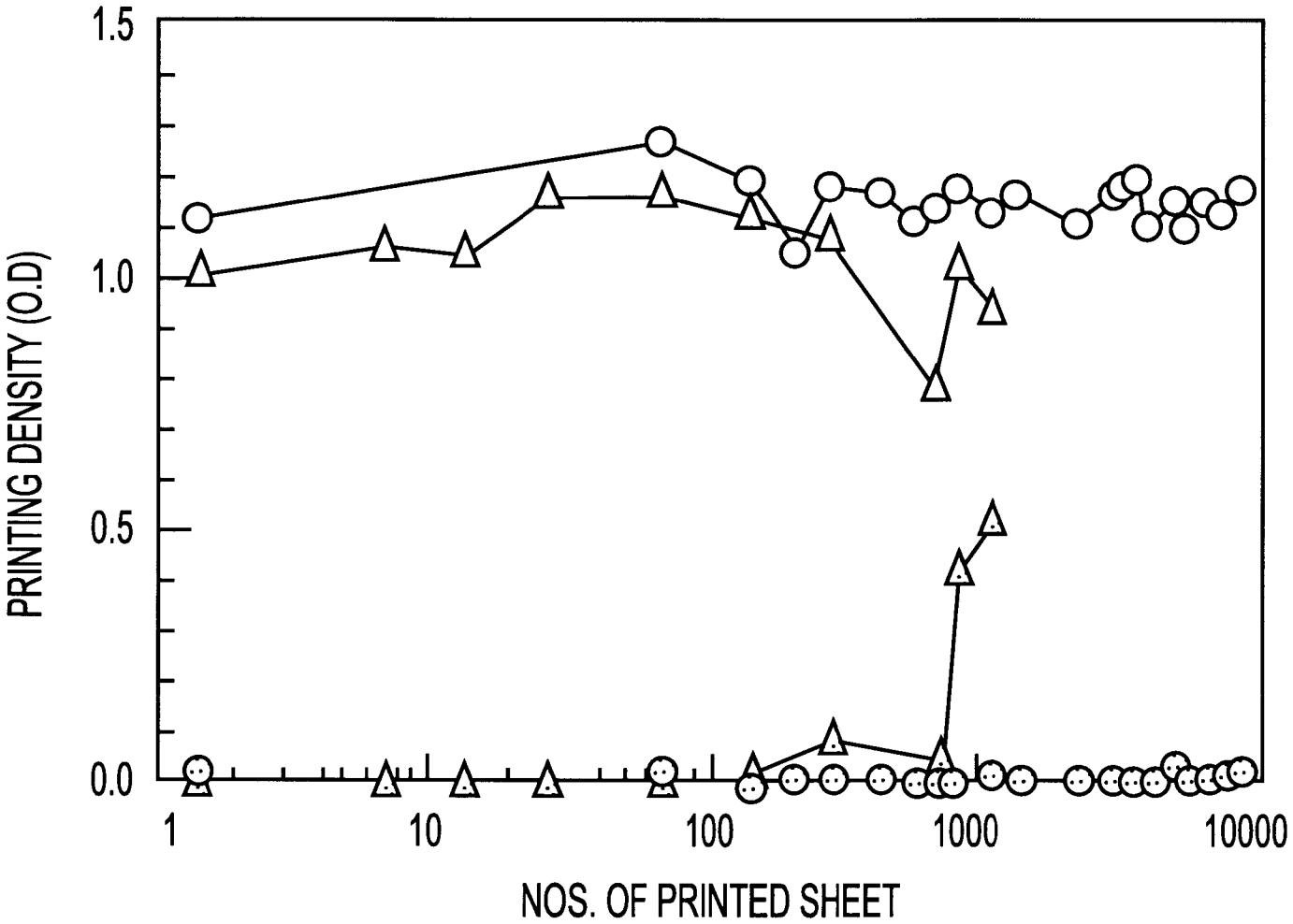
FIG. 12 is a diagram showing a print density characteristic of the brush charger shown in FIG. 11.

The advantage of the projection 25 will be described referring to FIG. 12. FIG. 12 presents characteristic charts showing the printing density with a change in the number of printed sheets both in the case of using a brush charger with the projection 25 (the curve with circular marks) and the case of using a brush charger without the projection 25 (the curve with triangular marks). With the printing density indicated by white triangles and the density of background noise indicated by black triangles, the printing density tends to become lower while the density of background noise tends to increase for the brush charger without the projection 25 when the number of printed sheets exceeds 1000. It is predictable from the above that the toners accumulate on the rotary endless latent carrier 20, reducing the charging performance. With the printing density indicated by white circles and the density of background noise indicated by white triangles for the brush charger with the projection 25, however, the printing density and the density of background noise do not change even when the number of printed sheets exceeds 1000. This implies that the toners do not accumulate on the charging brush 20, thus preventing the charging performance from dropping.

Figure 13:
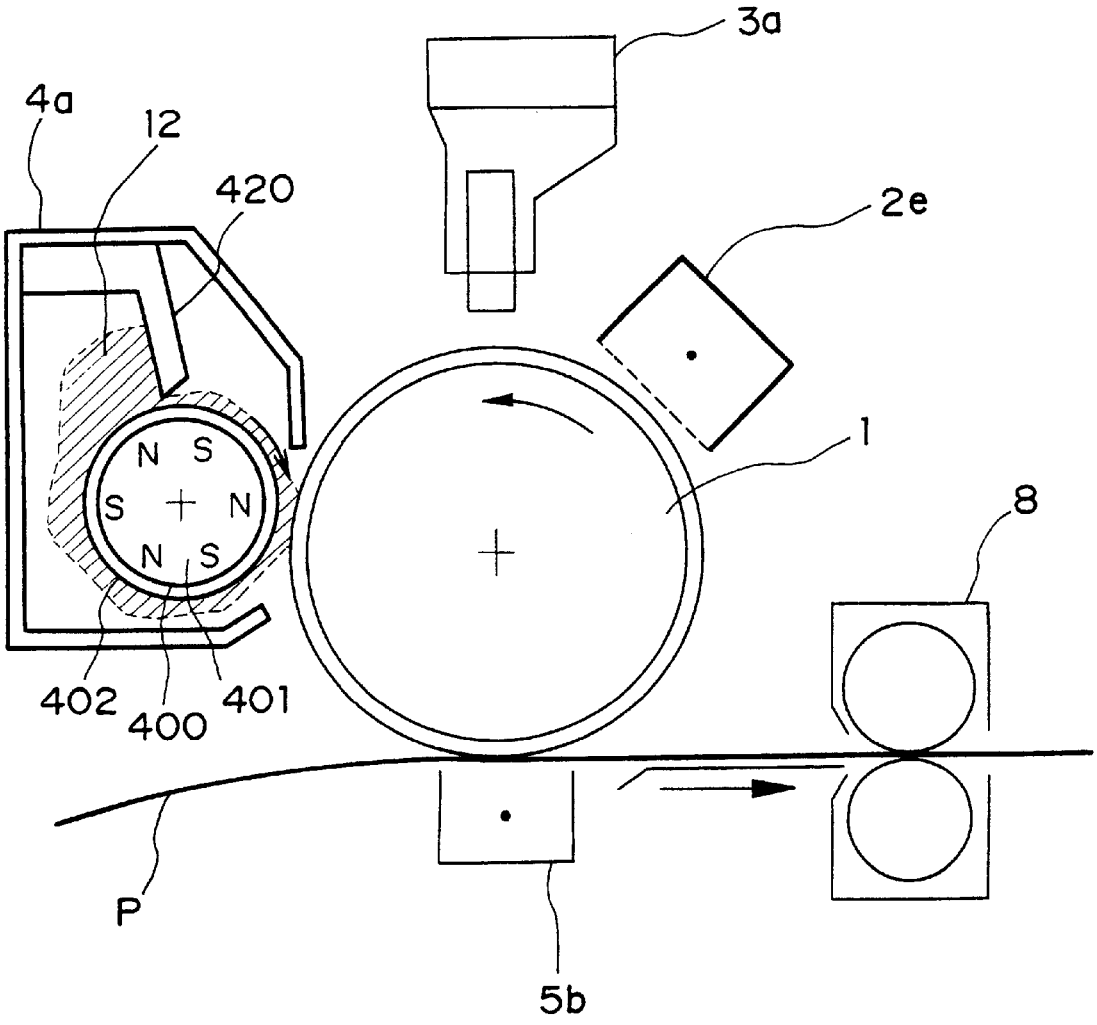
FIG. 13 is a diagram illustrating the structure of a printer according to a further embodiment of the present invention.
Figure 14:
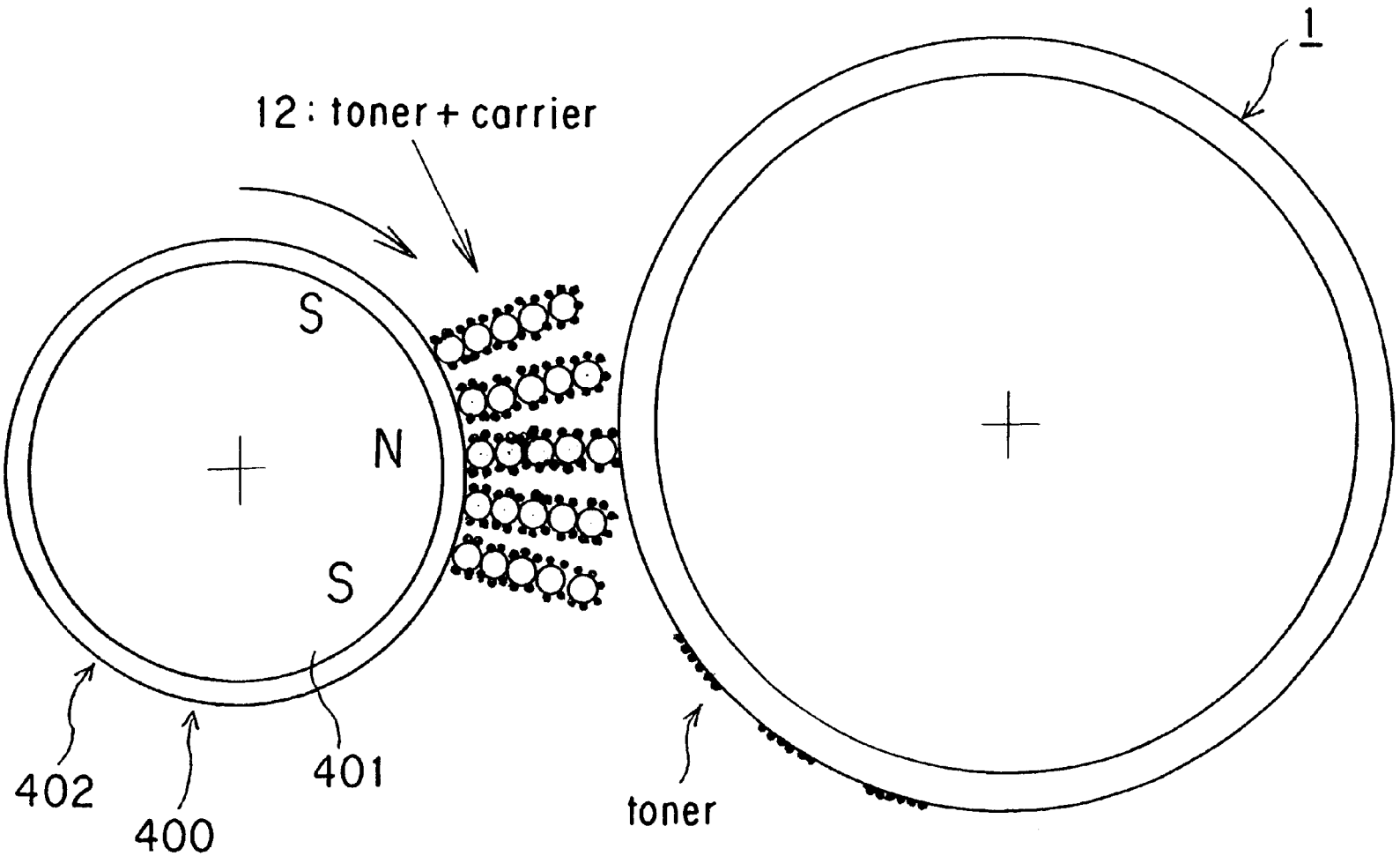
FIG. 14 is a diagram for explaining a developing step in the structure of FIG. 13.

FIG. 13 illustrates the structure of a printer for explaining a further modification of the present invention, and FIG. 14 is an exemplary diagram for the principle of the developing action taken by the printer of FIG. 13.

In FIG. 13, reference numeral "1" denotes the aforementioned photosensitive drum, which is constituted of an organic photosensitive body. A charger 2*e* is a corona charger. An image exposing device 3*a* is constituted of an LED array optical system. A developing device 4*a* is constituted of a 1.5-component developing device which uses magnetic carriers and magnetic toners. This developing device 4*a* contains magnetic carriers and magnetic toners as a developer 12. A developing roller 400 is constituted of a magnetic roller having a fixed magnet 401 and a rotatable metal sleeve 402 disposed therearound. A developing bias voltage is applied to this metal sleeve 402. Reference numeral "420" denotes a layer-thickness restricting blade which restricts the thickness of the developer layer on the developing roller 400. A transfer device 5*b* is constituted of a corona charger. Reference numeral "8" denotes the aforementioned fixing device.

As shown in FIG. 14, the developing principle is such that the action of the magnetic force of the developing roller 400 forms a magnetic brush, consisting of the magnetic carriers and magnetic toners, on the developing roller 400. This magnetic brush is conveyed by the developing roller 400 to the layer-thickness restricting blade 420 for the restriction of its thickness before being further conveyed to the photosensitive drum 1. When this magnetic brush comes in contact with the photosensitive drum 1, only the magnetic toners will stick on the photosensitive drum 1, thereby forming a toner image on the drum 1.

The operation of this embodiment will now be described. The surface of the photosensitive drum 1 is evenly charged to −700 V by the corona charger 2*e*. Then, image exposure is performed by the LED optical system 3*a* to form an electrostatic latent image with the background portion charged to −700 V and the exposed portion charged to −50 to −100 V, on the photosensitive drum 1. The electrostatic latent image on the photosensitive drum 1 is developed by magnetic polymerization toners, which have previously been charged negatively, in the 1.5-component developing device 4*a*, yielding a toner image. Then, the toner image on the photosensitive drum 1 is transferred onto a sheet of paper P through electrostatic force by the corona transfer device 5*b*. The toner image on the paper P is fixed by the fixing device 8. The toners remaining on the photosensitive drum 1 after transfer are charged by the corona charger 2*e*, and image exposure is then performed by the LED optical system 3*a*, forming a latent image. The collection of the residual toners and development of the latent image with the toners are carried out in the developing device 4*a*.

The magnetic carriers of this developer are magnetite carriers with an average particle size of about 70 $\mu$m, an electric resistance of $10^7$ to $10^{10}$ Ω·cm, a saturated magnetization of 70 emu/g and retention of 15 ersted. Ferrite carriers, iron powder carriers and so forth may also be used.

As the magnetic toners, magnetic polymerization toners produced by polymerization are used. The magnetic toners are acquired by polymerization of resin particles and magnetic particles of magnetite, thereby forming polymerization particles. The toners have the physical property values: an average particle size of about 7 $\mu$m, an electric resistance of $101^{10}$ Ω·cm or higher, a magnetite powder quantity of 40% by weight, a saturated magnetization of 20 emu/g and retention of 165 ersted.

Figure 15:
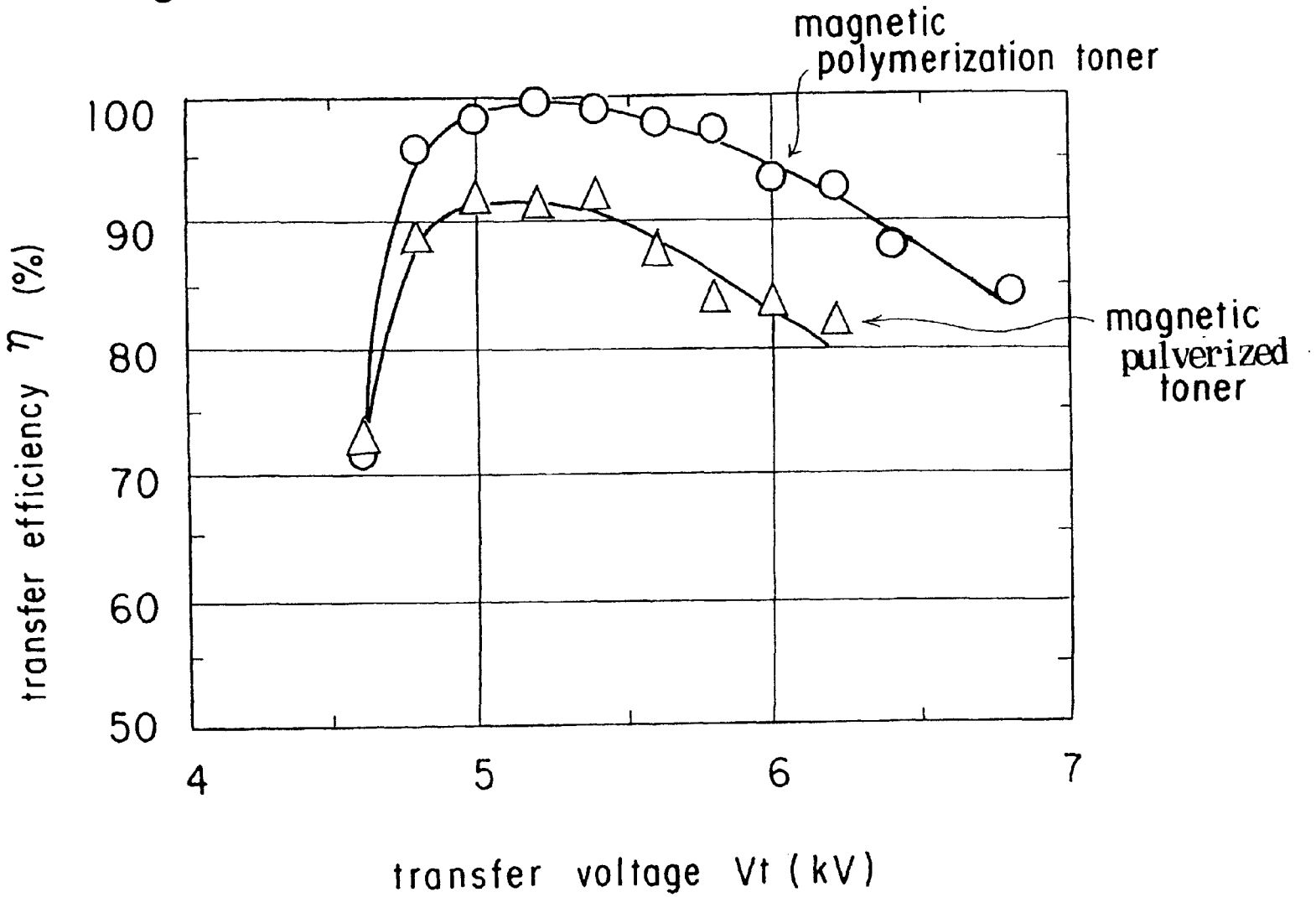
FIG. 15 is a diagram showing transfer efficiency characteristics of magnetic polymerization toners according to this invention and magnetic pulverized toners according to the prior art.
Figure 16:
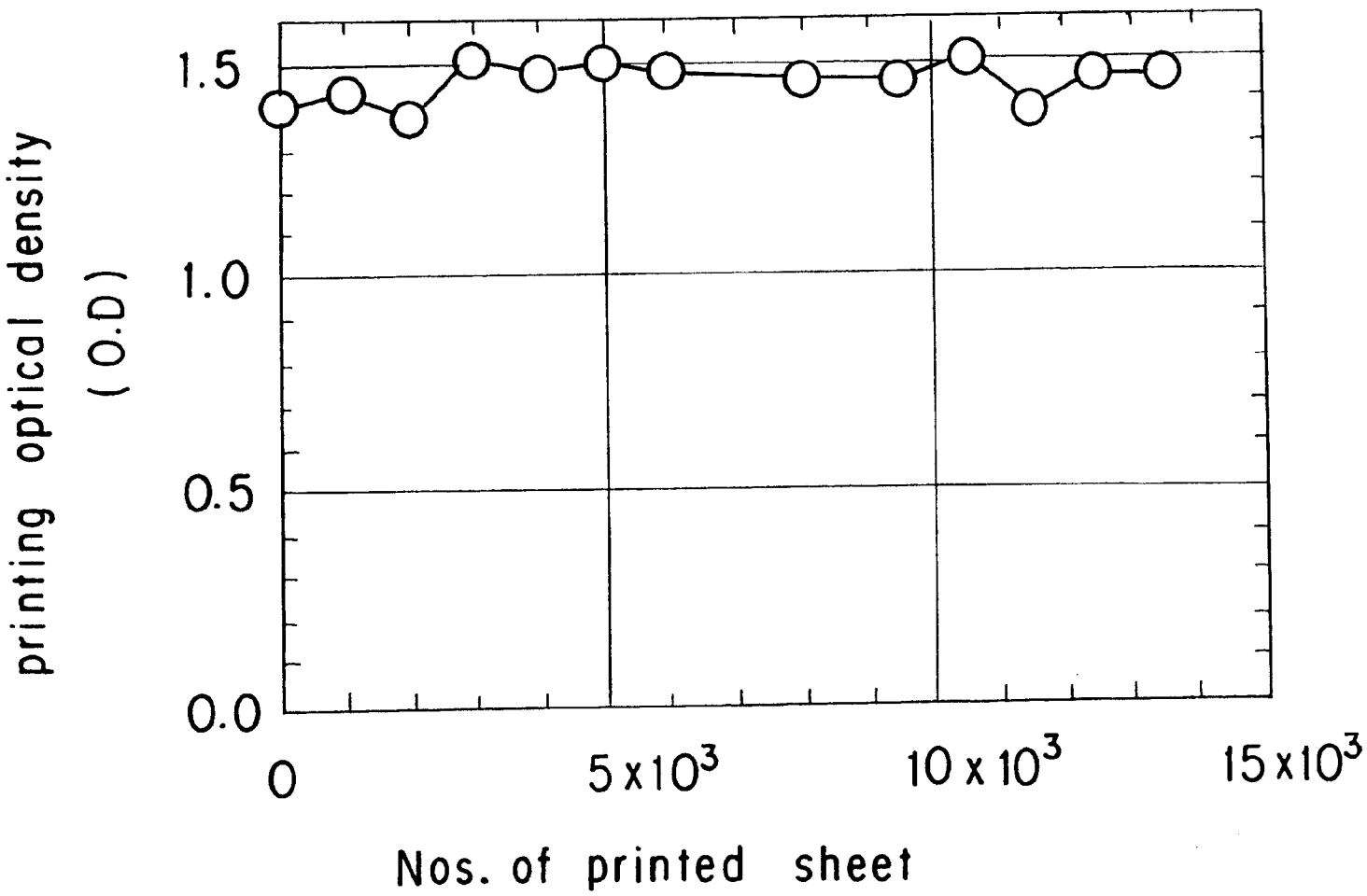
FIG. 16 is a diagram showing a print density characteristic of magnetic polymerization toners according to this invention.
Figure 17:
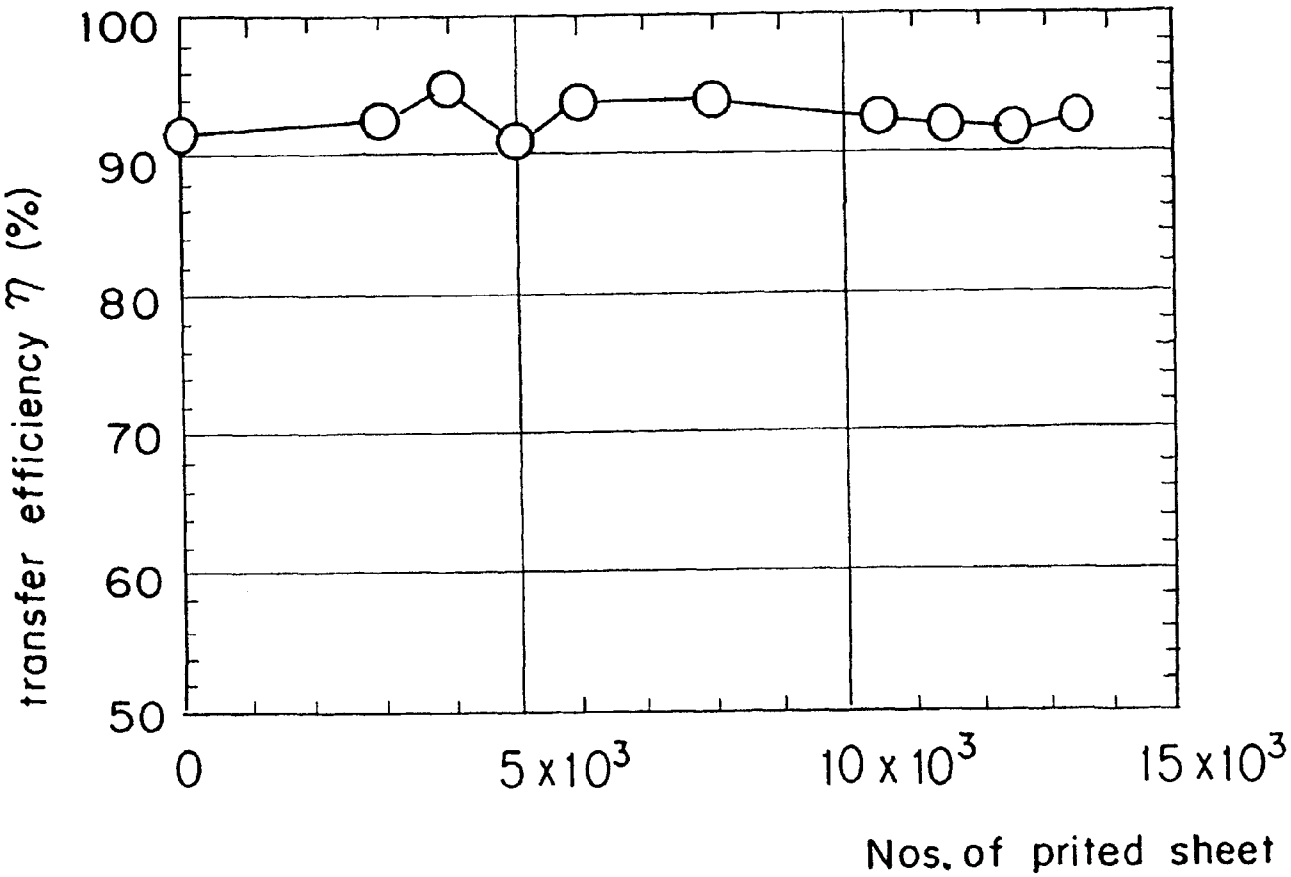
FIG. 17 is a diagram showing a transfer efficiency characteristic of magnetic polymerization toners according to this invention.

FIG. 15 shows the results of the comparison between the transfer efficiency in the conventional case of using magnetic pulverized toners and the transfer efficiency in the case of using magnetic polymerization toners as in the present invention. As shown in FIG. 15, as the transfer voltage applied by the corona transfer device 5*b* varies, the conventional magnetic pulverized toners provided the highest transfer efficiency of 92% whereas the magnetic polymerization toners as in the present invention provided the highest transfer efficiency of approximately 100%, which indicates excellent performance. Even for the printing of 15000 sheets, the printing density for the magnetic polymerization toners of the present invention is maintained at the initial value of about 1.5, as shown in FIG. 16. Further, even for the printing of 15000 sheets, the transfer efficiency for the magnetic polymerization toners of the present invention is maintained at the initial value of about 92% or greater, as shown in FIG. 17.

This difference may have resulted from the following reasons. First, because of smooth surfaces of the polymerization toners as shown in the model diagram of polymerization toners in FIG. 6A, the mechanical adhesive strength (van der Waals force) to the photosensitive drum 1 is small, so that transfer of a toner image to a sheet is easier. This improves the transfer efficiency. Secondly, as shown in the model diagram of transfer of polymerization toners in FIG. 7B, the particle distribution of the polymerization toners is narrow so that a clearance is not easily formed between the paper P and the toner image as described earlier. The transfer electric field is thus effectively applied, thus improving the transfer efficiency.

Although the use of both AC and DC power sources as the drive source for the charging brush 20 is mentioned in the description of the embodiments, only a DC drive source (constant current source) or an AC drive source may also serve as that drive source. Although a constant current source has been explained as the drive source for the transfer roller 50, it may be a constant voltage source. Further, while the brush charging, roller transfer and polymerization toners are all used in the foregoing description of the embodiments, they may be used singularly so that specific advantages can be expected, or may be properly combined to meet the required performance.

Although porous polyurethane sponge is used for the developing roller and transfer roller, sponges of urethane rubber and silicone rubber, silicone-base sponge, fluorine-base sponge, etc. may also be used. The transfer roller of the transfer means includes an endless transfer belt. Although a laser optical system or an LED optical system is used as the image exposing section, a liquid crystal shutter optical system and an EL (Electroluminescence) optical system may be used as well. While the foregoing description has been given with reference to the developing device which employs a one-component non-magnetic developing system or magnetic toner developing system, other well-known developing methods including a two-component magnetic brush developing method may also be used. Although the printing mechanism in the above-described embodiments has been explained as an electrophotograph mechanism, the present invention may also be applied to a printing mechanism which transfers a toner image (e.g., an electrostatic recording mechanism).

The sheet P is not limited to paper, but other types of media may also be used. Although the image forming apparatus has been described as a printer, it may be of other types, such as a copying machine and facsimile.

As many apparently widely different embodiments of the present invention can be made without departing from the spirit and scope thereof, it is to be understood that the invention is not limited to the specific embodiments thereof but may be modified within the scope of the appended claims.

What is claimed is:

1. An image-forming apparatus, comprising:

a rotary endless image carrier on which an electrostatic latent image is formed;

a charge device to charge said carrier;

an image forming device to form the electrostatic latent image on said carrier;

a developer to develop the electrostatic latent image on said carrier by supplying polymerization toners, the polymerization toners being supplied between an electrically charged developing roller and an electrically charged layer-thickness reducing blade;

a rotary transfer roller to press a sheet to said carrier with the polymerization toners and thereby transfer the developed electrostatic latent image to the sheet; and a transfer bias unit to apply a transfer bias current to said rotary transfer roller.

2. The image-forming apparatus according to claim 1, wherein said transfer bias unit supplies the transfer bias current of 2–10 $\mu$A.

3. The image-forming apparatus according to claim 1, wherein said transfer bias unit comprises a constant current source.

4. An image-forming method, comprising:

charging a rotary endless latent carrier;

forming an electrostatic latent image on the charged carrier;

developing the electrostatic latent image by supplying polymerization toners, the polymerization toners being supplied between an electrically charged developing roller and an electrically charged layer-thickness reducing blade; and transferring the polymerization toners on the rotary endless latent carrier to a sheet by pressing the sheet to the rotary endless latent carrier with a rotary transfer roller having a transfer bias current.

5. The image-forming method according to claim 4, wherein said transferring comprises supplying the transfer bias current of 2–10 $\mu$A.

6. A cleanerless image-forming apparatus comprising:

a rotary endless image carrier on which an electrostatic latent image is formed;

a charge device to charge said carrier;

an image forming device to form the electrostatic latent image on said carrier;

a developing device to develop the electrostatic latent image on said carrier and having a developing member apply a bias voltage for supplying at least polymerization toners to said carrier and collecting a residual toner on said carrier;

a rotary transfer roller to press a sheet to said carrier with the polymerization toners and thereby transfer the developed electrostatic latent image to the sheet; and a transfer bias unit to apply a transfer bias current to said rotary transfer roller.

7. The cleanerless image-forming apparatus according to claim 6, wherein said transfer bias unit comprises a constant current source.

8. The cleanerless image-forming apparatus according to claim 6,wherein said transfer bias unit supplies the transfer bias current of 2–10 $\mu$A.

9. A cleanerless image-forming method, comprising:

charging a rotary endless image carrier;

forming an electrostatic latent image on said carrier;

developing the electrostatic latent image by supplying at least polymerization toners to said carrier and collecting a residual toner on said carrier with a developing member applied bias voltage;

transferring the developed electrostatic latent image to a sheet by pressing the sheet to said carrier with the polymerization toners with a rotary transfer roller having a transfer bias current.

10. The cleanerless image-forming method according to claim 9, wherein said transferring comprises supplying a constant current to said rotary transfer roller.

11. The cleanerless image-forming method according to claim 9, wherein said transferring comprises supplying the transfer bias current of 2–10 $\mu$A.

* * * * *